US010436165B2

(12) United States Patent
Dileon et al.

(10) Patent No.: US 10,436,165 B2
(45) Date of Patent: Oct. 8, 2019

(54) METHOD FOR CLEANING INJECTORS OF A DIRECT-INJECTION CONTROLLED-IGNITION ENGINE

(71) Applicants: CONTINENTAL AUTOMOTIVE FRANCE, Toulouse (FR); CONTINENTAL AUTOMOTIVE GMBH, Hannover (DE)

(72) Inventors: Jerome Dileon, Gudas (FR); Jean-Luc Fremaux, Toulouse (FR); Philippe Serrecchia, Villenfranche de Lauragais (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 134 days.

(21) Appl. No.: 15/735,210

(22) PCT Filed: Jun. 22, 2016

(86) PCT No.: PCT/EP2016/001061
§ 371 (c)(1),
(2) Date: Dec. 11, 2017

(87) PCT Pub. No.: WO2016/206802
PCT Pub. Date: Dec. 29, 2016

(65) Prior Publication Data

US 2018/0171956 A1 Jun. 21, 2018

(30) Foreign Application Priority Data

Jun. 24, 2015 (FR) ..... 15 55835

(51) Int. Cl.
*F02M 65/00* (2006.01)
*F02D 41/24* (2006.01)
(Continued)

(52) U.S. Cl.
CPC ..... *F02M 65/008* (2013.01); *B08B 3/02* (2013.01); *B08B 9/0325* (2013.01);
(Continued)

(58) Field of Classification Search
CPC .. F02M 65/008; F02M 65/007; F02M 65/003; F02D 41/2467; F02D 29/02;
(Continued)

(56) References Cited

U.S. PATENT DOCUMENTS 4,977,872 A * 12/1990 Hartopp ..... F02M 65/001 123/198 A
2003/0178010 A1 9/2003 Baron et al.
(Continued)

FOREIGN PATENT DOCUMENTS

CN 102506001 A 6/2012
EP 0 364 167 A1 4/1990
(Continued)

OTHER PUBLICATIONS

International Search Report, dated Sep. 30, 2016, from corresponding PCT/EP2016/001061 application.

*Primary Examiner* — George C Jin
(74) *Attorney, Agent, or Firm* — Young & Thompson

(57) ABSTRACT

In a method of cleaning injectors of a direct-injection controlled-ignition engine, while idling, maximum fuel pressure to be injected for cleaning is calculated, by executing for at least one predetermined engine operating speed an iterative loop. During each loop the injected fuel pressure value increases and the injection time corresponding to the increased pressure is determined, selecting for each operating speed a cleaning pressure equal either to the maximum fuel pressure to which an injection time greater than the calibrated minimum injection time determined for the operating speed corresponds or to a maximum limit pressure
(Continued)

Figure 1:
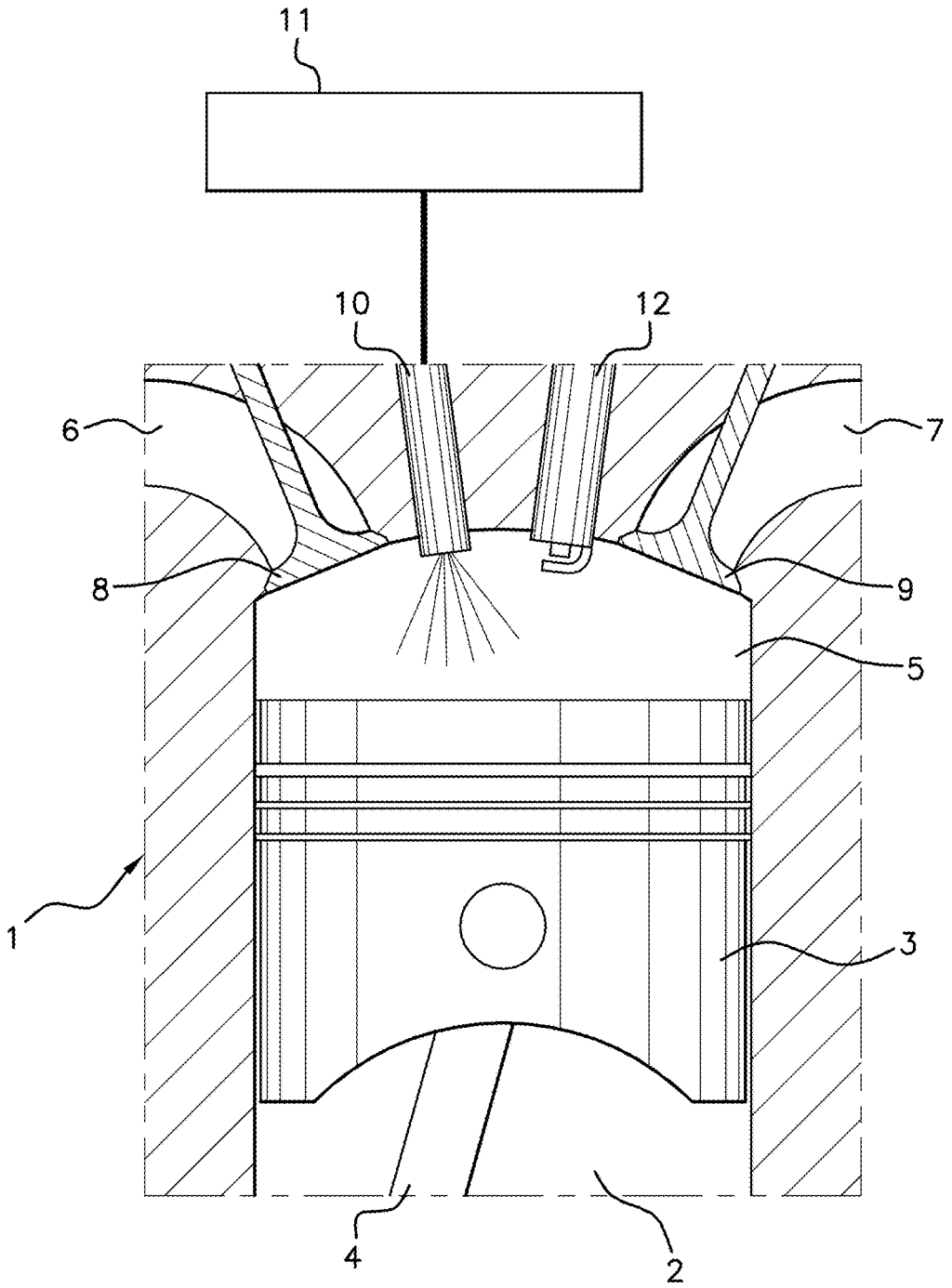

corresponding to a given calibrated pressure for the engine/injectors system. Secondly, a cleaning treatment includes selecting an operating speed allowing the maximum cleaning pressure and controlling an engine operation by applying this speed and programming the cleaning pressure over a treatment duration exceeding the operating time allowed while running under operating conditions of this kind.

20 Claims, 3 Drawing Sheets

(51) Int. Cl.
*B08B 3/02* (2006.01)
*B08B 9/032* (2006.01)
*F02D 29/02* (2006.01)

(52) U.S. Cl.
CPC ..... *F02D 41/2467* (2013.01); *F02D 29/02* (2013.01); *F02D 2200/06* (2013.01); *F02D 2200/101* (2013.01); *F02D 2200/1002* (2013.01)

(58) Field of Classification Search
CPC ..... F02D 2200/101; F02D 2200/1002; F02D 2200/06; B08B 3/02; B08B 9/0325; F01N 3/025; F01N 3/36; F01N 3/0256
See application file for complete search history.

(56) References Cited

U.S. PATENT DOCUMENTS

| | | | | |
|---|---|---|---|---|
| 2004/0260449 | A1 | 12/2004 | Heinstein et al. | |
| 2008/0295492 | A1 | 12/2008 | Gong et al. | |
| 2015/0204266 | A1* | 7/2015 | Mashiki | F02D 41/3094 701/103 |
| 2017/0159630 | A1* | 6/2017 | Li | F02D 37/02 |
| 2019/0032618 | A1* | 1/2019 | Soleri | F02M 21/0293 |

FOREIGN PATENT DOCUMENTS

| | | | |
|---|---|---|---|
| FR | 3 014 491 | A1 | 6/2015 |
| GB | 2 117 048 | A | 10/1983 |

* cited by examiner

METHOD FOR CLEANING INJECTORS OF A DIRECT-INJECTION CONTROLLED-IGNITION ENGINE

The invention relates to a method of cleaning injectors of a direct-injection controlled-ignition engine.

The injection openings of the injectors of direct-injection controlled-ignition engines regularly suffer a reduction in their fuel flow cross section resulting from a clogging phenomenon of these injection openings caused by the deposition of carbonated material commonly referred to as soot.

The result of a clogging phenomenon of this kind is a reduction in the amounts of fuel actually injected in relation to the amounts of fuel which are calculated and controlled by the engine control unit or ECU. In order to alleviate this reduction, the vehicles are equipped with a richness controller operating on the basis of measurements supplied by an oxygen sensor, currently referred to as a lambda sensor, which is located in the exhaust line and designed to increase the injection time, so that the amount of fuel injected coincides with the amount of fuel calculated by the ECU. However, this compensation is accompanied by a worsening of the pollution situation. Moreover, beyond a certain degree of clogging, the necessary correction cannot be carried out and this results in a drop in engine performance that is noticeable to the driver (over-consumption, loss of torque). This situation is indicated by a fault light coming on triggered by the on-board diagnostics (OBD), which warns the driver of the need to call in a professional to repair the injection system, something which, in the majority of cases, requires the injectors to be removed for cleaning or replacement.

The present invention aims to overcome this disadvantage and its main aim is to provide a method for cleaning the injectors of a direct-injection controlled-ignition engine designed to be implemented both as a preventative and also as a remedial measure, and adapted to perform the cleaning of the injectors with having to remove the latter.

To this end, the object of the invention is a method for cleaning injectors of a direct-injection controlled-ignition engine comprising a cleaning procedure carried out while the engine is idling which involves:

- calculating the maximum fuel pressure to be injected for cleaning, in other words the cleaning pressure, by executing for at least one predetermined operating speed of the engine and, taking as the point of origin the nominal operating point corresponding to this speed, an iterative loop, in other words a first iterative loop, during each lap of which the injected fuel pressure value is increased by a predetermined value and the injection time corresponding to said increased pressure is determined, and by selecting for each operating speed a cleaning pressure equal:
  - either to the maximum fuel pressure to which an injection time greater than the calibrated minimum injection time determined for said operating speed corresponds,
  - or to a maximum limit pressure corresponding to a given calibrated pressure for the engine/injectors system, if this calibrated pressure is reached during execution of the iterative loop,
- and to apply a cleaning treatment which involves selecting an operating speed allowing the cleaning pressure and controlling an engine operation by applying this speed and programming said cleaning pressure over a treatment duration greater than the operating time allowed while running under operating conditions of this kind.

First of all, the cleaning method according to the invention involves a cleaning procedure intended to be carried out while the engine is idling, in other words when the vehicle is at a standstill with the engine turning. Hence, this cleaning method can be carried out:

- as a preventive measure, for example systematically during each planned service interval of a vehicle, in such a manner as to guard against excessive soot formation which is likely to affect the operation of the engine and cause a warning light to come on,
- as a remedial measure when a warning light comes on triggered by the on-board diagnostics.

Moreover, this cleaning procedure does not require any "mechanical" intervention in terms of its implementation and involves, by way of the "after-sales service" built into the engine control unit:

- initially calculating, through the implementation of an iterative loop, the maximum fuel injection pressure, in other words the cleaning pressure, that can be used to clean the injectors and that corresponding to an operating zone that is not "dangerous" for the engine,
- then controlling the operation of the engine by programming the cleaning pressure over a treatment period greater than the operating time allowed while running under conditions of this kind.

According to an advantageous embodiment of the invention, prior to the start of the cleaning procedure, a heating stage of the engine is implemented over a lap of time adapted in order to achieve stabilization of the temperature of said engine.

This preliminary stage leads to the cleaning procedure being carried out at a stabilized engine temperature which, as a result, is not liable to affect the progress and result of this procedure.

Moreover, advantageously according to the invention, before the cleaning procedure is launched and after the cleaning procedure, respectively, there is a measurement of the data, in other words the lambda coefficient, characteristic of the ratio between the air/petrol mixture available and the necessary theoretical value, and a diagnostic is provided in relation to the effectiveness of said cleaning treatment, depending on the result of these measurements.

According to another advantageous embodiment of the invention, when, for a given operating speed of the engine, at the end of the first iterative loop, the selected cleaning pressure is lower than the maximum limit pressure, a second iterative loop is executed until the value of the torque margin is equal to or greater than a calibrated torque margin value, during each lap of which second iterative loop there is an increase in the first instance by a predetermined value of the engine torque through an isotorque increase in the torque margin, and the first iterative loop is then executed in its entirety.

(It should be noted that "torque margin" is traditionally understood to mean defining, when there is a resulting change in torque, for a constant mass of injected air, of a change in the ignition advance, the relationship between the maximum torque and the torque obtained for a given value of the ignition advance. The calibrated torque margin value itself usually involves a lower torque value, below which the operating zone is dangerous to the engine).

According to this advantageous embodiment, determination of the cleaning pressure combines, for each speed, a first iterative loop for which the increased parameter involves the pressure of the injected fuel, and a second iterative loop in which the first iterative loop is integrated, and for which the increased parameter is representative of the engine load.

This combination of two iterative loops means that a greater value of the cleaning pressure is obtained, while guaranteeing "non-dangerous" operating conditions for the engine during the determination phase of the value of this cleaning pressure and during the cleaning treatment.

Moreover, advantageously according to the invention and always with the aim of obtaining the highest possible cleaning pressure, when, for a predetermined operating speed of the engine, at the end of the second iterative loop the selected cleaning pressure is lower than the maximum pressure limit, the activation of consumer loads such as heating, demisting, headlamps, air conditioning is controlled in such a manner as to generate an increase in the resistive torque of the engine, and execution of the first iterative loop then possibly of the second iterative loop is resumed.

Moreover, according to another advantageous embodiment of the invention and, particularly, with a view to obtaining the highest possible cleaning pressure, the cleaning pressure is calculated successively for a plurality of different predetermined operating speeds of the engine and, for the purpose of the cleaning treatment, an operating speed allowing a maximum cleaning pressure is selected.

Moreover, when a plurality of operating speeds allow a maximum cleaning pressure, the highest speed for the purposes of cleaning is advantageously selected according to the invention. The choice of the highest speed in fact allows the effectiveness of the treatment performed to be increased for a same treatment duration, due to the greater number of injections performed per unit of time.

According to another advantageous embodiment of the invention, the cleaning pressure for the highest predetermined operating speed of the engine is calculated first of all, then successively for operating speeds with a diminishing value, and the cleaning treatment is applied directly when, for one of said operating speeds, the chosen cleaning pressure involves the maximum limit pressure.

Moreover, for the purpose of obtaining the cleaning pressure during the cleaning treatment, when the maximum limit pressure is not reached during execution of the first iterative loop, a step-by-step increase in a predetermined value of the injected fuel pressure value is advantageously actuated according to the invention from the nominal operating point corresponding to the selected speed, then possibly, where necessary, a step-by-step increase in a predetermined value of the torque margin, until said cleaning pressure is obtained.

Figure 2:
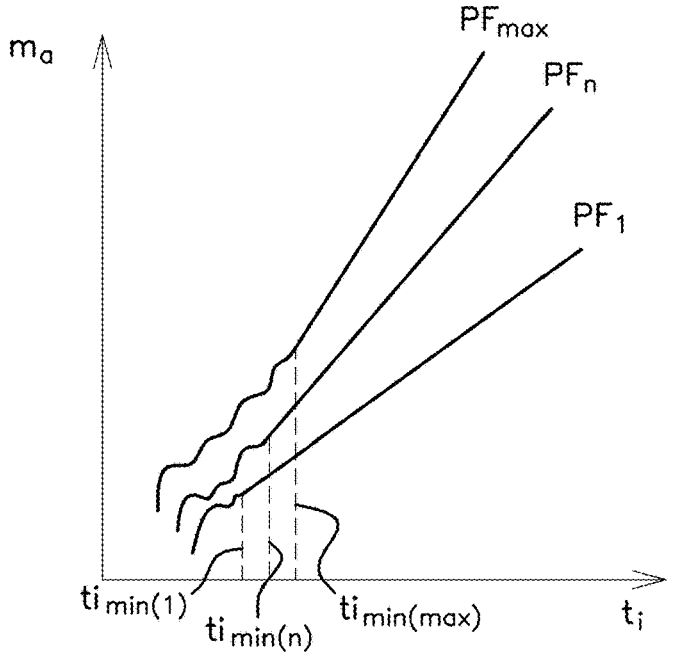
Figure 3:
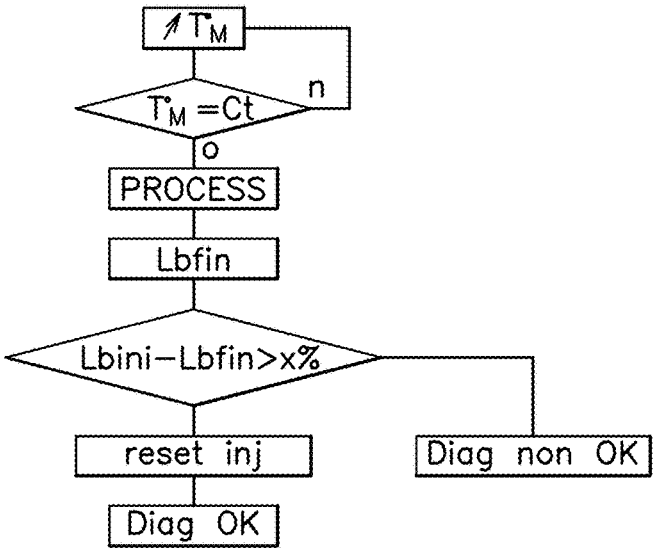
Figure 4:
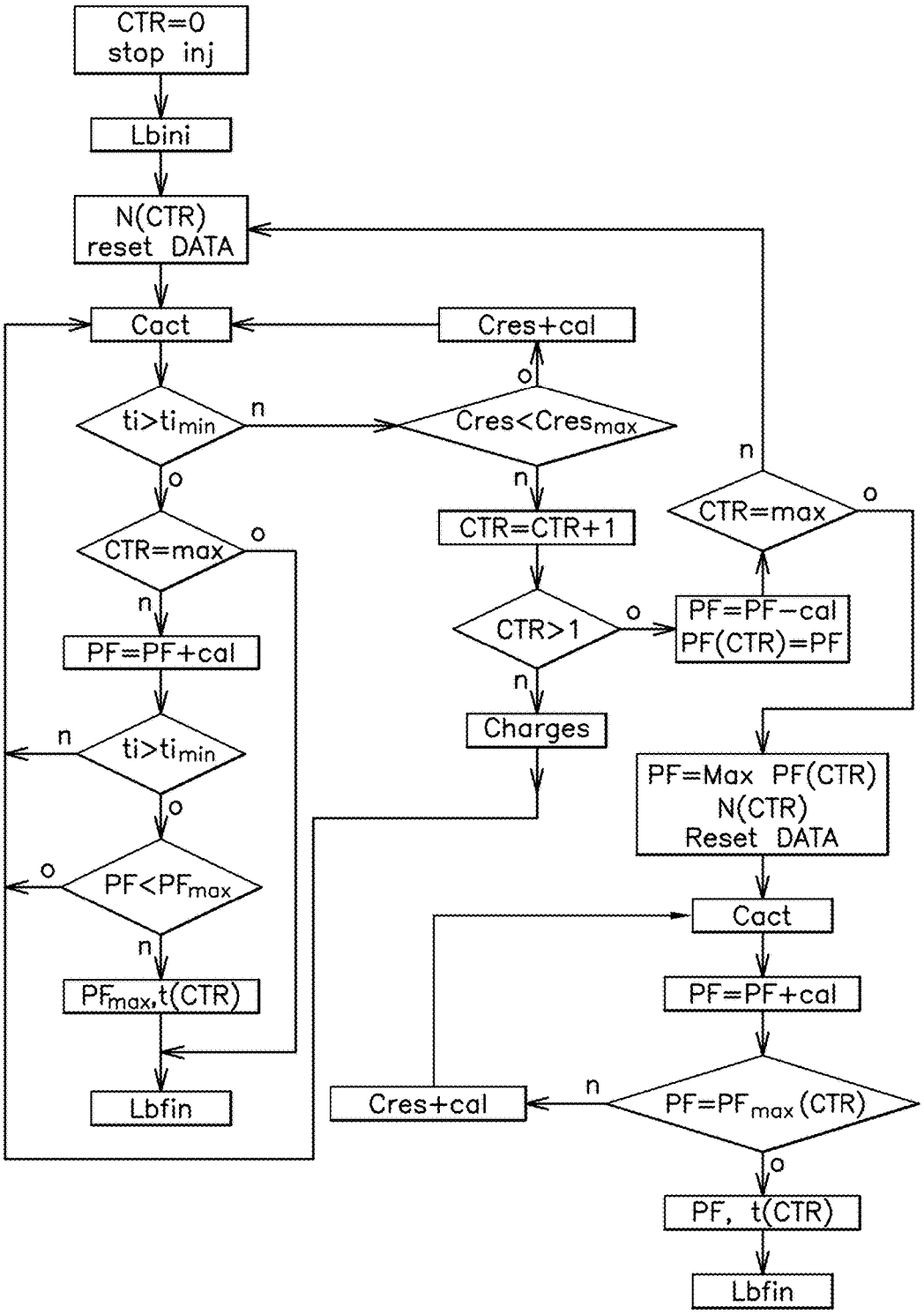

Other characteristic goals and advantages of the invention will emerge from the detailed description that follows with reference to the attached drawings which represent, by way of a non-limiting example, a preferred embodiment. In these drawings:

FIG. 1 is a schematic view representing a direct-injection controlled-ignition engine, FIG. 2 is a graph depicting a plurality of fuel injection pressure curves, FIG. 3 shows the general flow chart of the cleaning procedure according to the invention, and FIG. 4 represents the algorithm of the cleaning procedure implemented according to the cleaning method in the invention.

The method according to the invention aims at a cleaning method, whether preventative or remedial, of injectors of an engine 1 with controlled ignition and direction injection, as depicted in FIG. 1.

According to this FIG. 1, the direct-injection controlled-ignition engine 1 is represented in the form of a single cylinder 2 containing a piston 3 activating a connecting rod 4 and delimiting a combustion chamber 5 on the inside of said cylinder.

This engine 1 further comprises:

an inlet valve 8 positioned on an air inlet line 6, an exhaust valve 9 positioned on an exhaust line 7, an injector 10 positioned in such a manner as to inject the fuel directly into the combustion chamber 5, controlled by the engine control unit 11 of the vehicle, programmed in such a manner as to determine the injection pressure PF and the injection time ti during each cycle, and a spark plug 12.

The object of the invention is to allow the injectors 10 of this engine 1 to be cleaned either as a preventative or remedial measure, and, to this end, the method according to the invention particularly involves a cleaning procedure adapted to be implemented when the aforementioned engine is idling.

As shown in FIG. 3, the cleaning method considered in its entirety, prior to the cleaning procedure referred to as the "PROCESS" in this FIG. 3 and which will be described in detail below with reference to FIG. 4, comprises a preliminary heating stage of the engine 1 with a duration adapted to obtain stabilization of the temperature $T°_M$ of said engine.

Moreover, following the implementation of the cleaning procedure, this cleaning method comprises an information stage on the effectiveness of this cleaning procedure.

This information stage involves firstly measuring the lambda air coefficient Lbfin, which is characteristic of the relationship between the available air/petrol mixture and the necessary theoretical value, comparing this measured value Lbfin with the corresponding Lbini value measured when the cleaning procedure begins, and delivering either an unfavorable diagnostic in relation to the effectiveness of the cleaning procedure when the difference (Lbfin−Lbini) is below a predetermined threshold, or a successful diagnostic for the cleaning procedure when the value (Lbfin−Lbini) is greater than the predetermined threshold.

Moreover, in the event of a positive diagnostic, the issuing of this diagnostic is preceded by a reinitialization of the parameters defining the injection conditions.

The cleaning procedure described below with reference to FIG. 4 itself comprises a first phase intended to determine injection conditions during the cleaning treatment of the injectors 10 which constitutes the second phase of this cleaning procedure, with the aim of applying, during this treatment, a cleaning pressure equal to, or as close as possible to, a maximum limit pressure $PF_{max}$ corresponding to a calibrated pressure determined for the engine 1/injectors 10 system.

Another parameter used in the framework of this cleaning procedure involves a counting parameter CTR for each value for which, except for the max CTR, there is an associated engine speed value.

For purposes better understood below, the values CTR(0) and CTR(1) of the counter are linked to a same engine speed value Nmax corresponding to the preselected highest engine operating speed 1. The following values CTR(2), . . . CTR(n), . . . CTR(max−1) correspond successively to preselected decreasing engine speed values N2 . . . > Nn . . . >N(max−1).

The cleaning procedure firstly involves two preliminary stages:

an initialization stage of the counter (CTR=0) and injection data which involve inhibiting the injection parameters previously applied, a measuring stage of the lambda air coefficient Lbini, characteristic of the relationship between the available air/petrol mixture and the necessary theoretical value.

The initial stage of this cleaning procedure then involves controlling the engine operation 1 at the highest preselected engine speed Nmax t/mn in operating conditions corresponding to the nominal operating point corresponding to this speed.

Based on these data, the first iteration involves an iterative loop involving a step-by-step increase in the injection pressure value PF, with a step cal, for example such that cal=10 bars, and after each increase, comparing the calculated injection time ti with the injection time $ti_{min(1)}$ associated with the increased pressure, in such a manner:

either to increase by a new step the injection pressure value PF, until a pressure PF at least equal to the value $PF_{max}$ is possibly reached or to execute a second iterative loop if $ti<ti_{min}$ (such as that represented in FIG. 2, for an isobar curve $PF_1$, $PF_2$ . . . $PF_{max}$ of the injection pressure, the value $ti_{min(1)}$, $ti_{min(2)}$ . . . $ti_{min(max)}$ traditionally corresponds to the injection time below which the injection data are no longer controlled).

The execution of this second iterative loop itself involves, during each lap of this second loop, and provided that the torque margin value Cres remains lower than a calibrated torque margin value $Cres_{max}$:

firstly increasing by a step cal, for example such that cal=2 N·m, the engine torque by an isocouple increase in the torque margin Cres, secondly, then executing the first iterative loop in its entirety.

At the end of this second iterative loop, assuming that the value $PF_{max}$ has not been reached, the following stage involves increasing the counter CTR by one unit.

Moreover, the first increase of the counter CTR, the increase from CTR=0 to CTR=1, triggers the activation of consumer loads such as heating, demisting, headlamps, air conditioning, and, consequently, causes an increase in the resistive torque of the engine 1, followed by a relaunch at the same engine speed Nmax of the execution of the first iterative loop, then possibly of the second iterative loop.

Following each of the following increases of the counter CTR (CTR>1), the first stage involves memorizing the cleaning pressure previously obtained (maximum pressure PF obtained with a value of $ti>ti_{min}$), as well as the conditions under which this cleaning pressure is obtained; engine speed associated with the value of the counter CTR, and load (torque) of the engine 1.

The first and second loops are then executed again for successive preselected speeds of the engine 1, while keeping the consumer loads activated:

either until the maximum pressure $PF_{max}$ is obtained, or until the end of the calculating procedure of the cleaning pressure corresponding to an increase to the max value of the counter CTR.

The procedure described above for determining the maximum cleaning pressure likely to be used for the purpose of the cleaning treatment therefore results in the selection either of an injection pressure equal to the maximum limit pressure $PF_{max}$, or a pressure lower than this maximum limit pressure.

In the first case, cleaning pressure=$PF_{max}$, this pressure is reached at the end of the execution of the first iterative loop, in conditions in which the actual injection pressure is equal to $PF_{max}$. The cleaning treatment may therefore be directly used while maintaining said cleaning pressure over a predetermined treatment period greater than the operating time allowed while running under identical operating conditions.

On the other hand, when the procedure described above does not allow a cleaning pressure equal to $PF_{max}$ to be reached at the end of the implementation of the two iterative loops for each of the speeds of the engine 1, the selected cleaning pressure involves the maximum pressure obtained and, assuming that this maximum pressure is identical for a plurality of engine speeds 1, this maximum pressure is associated with the highest engine speed for treatment purposes.

In this case, moreover, the cleaning treatment firstly involves controlling the engine operation 1 at the preselected engine speed in operating conditions corresponding to the nominal operating point corresponding to this speed.

Next, with a view to obtaining the cleaning pressure, a step-by-step increase in a predetermined value of the injected fuel pressure value is actuated, then possibly, where necessary, a step-by-step increase in a predetermined value of the torque margin, until said cleaning pressure is obtained.

Finally, the cleaning treatment is carried out by programming the cleaning pressure for a predetermined treatment period greater than the operating time allowed while running in identical operating conditions.

Moreover, since the cleaning pressure in this case is lower than the maximum limit pressure $PF_{max}$, the treatment duration is extended in respect of the predetermined treatment duration for treatment carried out, for a same engine speed, at said maximum limit pressure.

A method of this kind for cleaning injectors of a direct-injection controlled-ignition engine has as its essential advantages that of being designed to be implemented both preventatively and also remedially, and that of being adapted to undertake cleaning of the injectors without requiring removal of the latter.

The invention claimed is:

1. A method of cleaning injectors (10) of a direct-injection controlled-ignition engine (1), comprising a cleaning procedure carried out while the engine is idling which involves:

calculating the maximum fuel pressure to be injected for cleaning, in other words the cleaning pressure, by executing for at least one predetermined operating speed of the engine (1) and, taking as the point of origin the nominal operating point corresponding to this speed, an iterative loop, in other words a first iterative loop, during each lap of which the injected fuel pressure value is increased by a predetermined value and the injection time corresponding to said increased pressure is determined, and by selecting for each operating speed a cleaning pressure equal:

either to the maximum fuel pressure to which an injection time greater than the calibrated minimum injection time determined for said operating speed corresponds, or to a maximum limit pressure corresponding to a given calibrated pressure for the engine (1)/injectors (10) system, if this calibrated pressure is reached during execution of the iterative loop, and to apply a cleaning treatment which involves selecting an operating speed allowing the cleaning pressure and controlling an engine operation (1) by applying this speed and programming said cleaning pressure over a treatment duration greater than the operating time allowed while running under operating conditions of this kind.

2. The cleaning method as claimed in claim 1 wherein prior to the start of the cleaning procedure, a heating stage of the engine (1) is implemented over a lap of time adapted in order to achieve stabilization of the temperature of said engine.

3. The cleaning method as claimed in claim 1 wherein before the cleaning procedure is launched and after the cleaning procedure, respectively, there is a measurement of the data, in other words the lambda coefficient, characteristic of the ratio between the air/petrol mixture available and the necessary theoretical value, and a diagnostic is provided in relation to the effectiveness of said cleaning treatment, depending on the result of these measurements.

4. The cleaning method as claimed in claim 1 wherein when, for a given operating speed of the engine (1), at the end of the first iterative loop, the selected cleaning pressure is lower than the maximum limit pressure, a second iterative loop is executed until the value of a torque margin is equal to or greater than a calibrated torque margin value, during each lap of which second iterative loop there is an increase in the first instance by a predetermined value of the engine torque through an isotorque increase in the torque margin, and the first iterative loop is then executed in its entirety.

5. The cleaning method as claimed in claim 4 wherein when, for a predetermined operating speed of the engine (1), at the end of the second iterative loop the selected cleaning pressure is lower than the maximum pressure limit, the activation of consumer loads such as heating, demisting, headlamps, air conditioning is controlled in such a manner as to generate an increase in a resistive torque of the engine (1), and execution of the first iterative loop then possibly of the second iterative loop is resumed.

6. The cleaning method as claimed in claim 1, wherein the cleaning pressure is calculated successively for a plurality of different predetermined operating speeds of the engine (1) and, for the purpose of the cleaning treatment, an operating speed allowing a maximum cleaning pressure is selected.

7. The cleaning method as claimed in claim 6 characterized in that when a plurality of operating speeds allow a maximum cleaning pressure, the highest speed for the purposes of cleaning is selected.

8. The cleaning method as claimed in claim 6 wherein the cleaning pressure for the highest predetermined operating speed of the engine (1) is calculated first of all, then successively for operating speeds with a diminishing value, and the cleaning treatment is applied directly when, for one of said operating speeds, the chosen cleaning pressure involves the maximum limit pressure.

9. The cleaning method as claimed in claim 6 wherein with a view to obtaining the cleaning pressure during the cleaning treatment, a step-by-step increase in a predetermined value of the injected fuel pressure value is actuated from the nominal operating point corresponding to the selected speed, then possibly, where necessary, a step-by-step increase in a predetermined value of a torque margin, until said cleaning pressure is obtained.

10. The cleaning method as claimed in claim 2, wherein before the cleaning procedure is launched and after the cleaning procedure, respectively, there is a measurement of the data, in other words the lambda coefficient, characteristic of the ratio between the air/petrol mixture available and the necessary theoretical value, and a diagnostic is provided in relation to the effectiveness of said cleaning treatment, depending on the result of these measurements.

11. The cleaning method as claimed in claim 2 wherein when, for a given operating speed of the engine (1), at the end of the first iterative loop, the selected cleaning pressure is lower than the maximum limit pressure, a second iterative loop is executed until the value of a torque margin is equal to or greater than a calibrated torque margin value, during each lap of which second iterative loop there is an increase in the first instance by a predetermined value of the engine torque through an isotorque increase in the torque margin, and the first iterative loop is then executed in its entirety.

12. The cleaning method as claimed in claim 3 wherein when, for a given operating speed of the engine (1), at the end of the first iterative loop, the selected cleaning pressure is lower than the maximum limit pressure, a second iterative loop is executed until the value of a torque margin is equal to or greater than a calibrated torque margin value, during each lap of which second iterative loop there is an increase in the first instance by a predetermined value of the engine torque through an isotorque increase in the torque margin, and the first iterative loop is then executed in its entirety.

13. The cleaning method as claimed in claim 2, wherein the cleaning pressure is calculated successively for a plurality of different predetermined operating speeds of the engine (1) and, for the purpose of the cleaning treatment, an operating speed allowing a maximum cleaning pressure is selected.

14. The cleaning method as claimed in claim 3, wherein the cleaning pressure is calculated successively for a plurality of different predetermined operating speeds of the engine (1) and, for the purpose of the cleaning treatment, an operating speed allowing a maximum cleaning pressure is selected.

15. The cleaning method as claimed in claim 4, wherein the cleaning pressure is calculated successively for a plurality of different predetermined operating speeds of the engine (1) and, for the purpose of the cleaning treatment, an operating speed allowing a maximum cleaning pressure is selected.

16. The cleaning method as claimed in claim 5, wherein the cleaning pressure is calculated successively for a plurality of different predetermined operating speeds of the engine (1) and, for the purpose of the cleaning treatment, an operating speed allowing a maximum cleaning pressure is selected.

17. The cleaning method as claimed in claim 10, wherein the cleaning pressure is calculated successively for a plurality of different predetermined operating speeds of the engine (1) and, for the purpose of the cleaning treatment, an operating speed allowing a maximum cleaning pressure is selected.

18. The cleaning method as claimed in claim 11, wherein the cleaning pressure is calculated successively for a plurality of different predetermined operating speeds of the engine (1) and, for the purpose of the cleaning treatment, an operating speed allowing a maximum cleaning pressure is selected.

19. The cleaning method as claimed in claim 12, wherein the cleaning pressure is calculated successively for a plurality of different predetermined operating speeds of the engine (1) and, for the purpose of the cleaning treatment, an operating speed allowing a maximum cleaning pressure is selected.

20. The cleaning method as claimed in claim 7 wherein the cleaning pressure for the highest predetermined operating speed of the engine (1) is calculated first of all, then successively for operating speeds with a diminishing value, and the cleaning treatment is applied directly when, for one of said operating speeds, the chosen cleaning pressure involves the maximum limit pressure.

* * * * *